US006238519B1

(12) United States Patent
Jones et al.

(10) Patent No.: US 6,238,519 B1
(45) Date of Patent: May 29, 2001

(54) SOFT ABSORBENT PAPER PRODUCT CONTAINING DEACTIVATED KETENE DIMER AGENTS

(75) Inventors: David A. Jones, Hillsboro, OR (US); Nancy C. Clungeon, Manawa, WI (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/195,581

(22) Filed: Nov. 18, 1998

(51) Int. Cl.[7] ..... D21H 17/14; D21H 17/17

(52) U.S. Cl. ..... 162/123; 162/111; 162/112; 162/125; 162/127; 162/129; 162/130; 162/158; 162/179

(58) Field of Search ..... 162/111, 112, 162/113, 123, 125, 127, 130, 158, 179

(56) References Cited

U.S. PATENT DOCUMENTS

| | | | |
|---|---|---|---|
| 3,683,917 | 8/1972 | Comerford | 128/287 |
| 3,922,243 | 11/1975 | Aldrich et al. | 260/29.2 EP |
| 3,957,574 | 5/1976 | Anderson | 162/167 |
| 3,968,317 | 7/1976 | Dumas | 428/537 |
| 3,988,280 | 10/1976 | Aldrich et al. | 260/29.2 EP |
| 3,990,939 | 11/1976 | Aldrich et al. | 162/164 EP |
| 4,017,431 | 4/1977 | Aldrich | 260/18 N |
| 4,087,395 | 5/1978 | Aldrich et al. | 260/29.2 EP |
| 4,240,935 | 12/1980 | Dumas | 260/9 |
| 4,243,481 | 1/1981 | Dumas | 162/158 |
| 4,279,794 | 7/1981 | Dumas | 260/29.2 EP |
| 4,295,931 | 10/1981 | Dumas | 162/158 |
| 4,407,994 | 10/1983 | Bankert et al. | 524/107 |
| 4,478,682 | 10/1984 | Bankert et al. | 162/158 |
| 4,648,876 | 3/1987 | Becker et al. | 604/370 |
| 4,652,390 | 3/1987 | Strampach et al. | 252/92 |
| 4,657,538 | 4/1987 | Becker et al. | 604/381 |
| 4,735,738 | 4/1988 | Willman | 252/90 |
| 4,861,376 | 8/1989 | Edwards et al. | 106/123.1 |
| 4,885,204 | 12/1989 | Bither et al. | 428/284 |
| 4,919,724 | 4/1990 | Cenisio et al. | 106/199 |
| 4,925,530 | 5/1990 | Sinclair et al. | 162/164 |
| 4,927,496 | 5/1990 | Walkden | 162/136 |
| 5,015,334 | 5/1991 | Derrick | 162/168 |
| 5,163,931 | 11/1992 | Aldrett | 604/374 |
| 5,399,366 | 3/1995 | Geddes et al. | 426/87 |
| 5,431,997 | 7/1995 | Scott et al. | 428/290 |
| 5,480,693 | 1/1996 | Patterson et al. | 428/36.7 |
| 5,484,952 | 1/1996 | Nolan et al. | 549/329 |
| 5,525,738 | 6/1996 | Zhang | 549/329 |
| 5,560,945 | 10/1996 | Geddes et al. | 426/87 |
| 5,571,379 | 11/1996 | Derrick | 162/168.1 |
| 5,582,674 | 12/1996 | Patterson et al. | 156/290 |
| 5,609,901 | 3/1997 | Geddes et al. | 426/394 |

FOREIGN PATENT DOCUMENTS 0 144 658 A1 10/1984 (EP) .

OTHER PUBLICATIONS

English translation of Japanese abstract 2 091 300 A.

*Primary Examiner*—Peter Chin

(57) ABSTRACT

New and improved methods and products are disclosed relating to increasing the softness of paper sheets, without effecting their wetability. Increased softness, without loss of wetability is obtained by adding deactivated ketene dimer sizing agents to the sheet.

8 Claims, 1 Drawing Sheet

SOFT ABSORBENT PAPER PRODUCT CONTAINING DEACTIVATED KETENE DIMER AGENTS

BACKGROUND OF THE INVENTION

Figure 1:
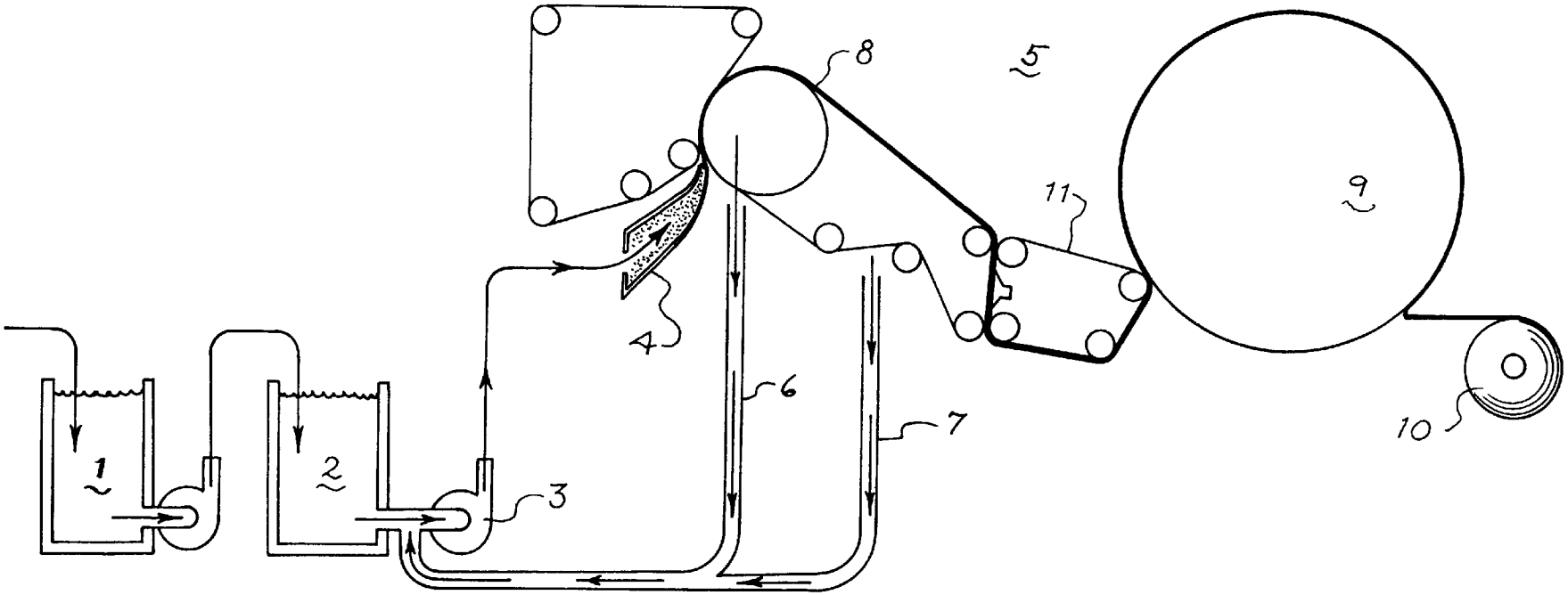

The use of ketene dimer based agents in the paper industry to impart sizing, or water resistivity, to paper products is well known. Such agents are commercially available from Hercules Inc. Wilmington, Del. under trade names such as AQUAPEL® and HERCON®. Patents disclosing the compositions, variations and uses of these types of agents are:

| Inventor | Patent No. | Issued |
|---|---|---|
| Aldrich et al. | 3,922,243 | Nov. 25, 1975. |
| Anderson | 3,957,574 | May 18, 1976. |
| Aldrich, et al. | 3,990,939 | Nov. 9, 1976. |
| Aldrich | 4,017,431 | Apr. 12, 1977. |
| Aldrich et al. | 4,087,395 | May 2, 1978. |
| Dumas | 4,240,935 | Dec. 23, 1980. |
| Dumas | 4,243,481 | Jan. 6, 1981. |
| Dumas | 4,279,794 | Jul. 21, 1981. |
| Dumas | 4,295,931 | Oct. 20, 1981. |
| Bankert et al. | 4,407,994 | Oct. 4, 1983. |
| Bankert et al. | 4,478,682 | Oct. 23, 1984. |
| Edwards et al. | 4,861,376 | Aug. 29, 1989. |
| Cenisio et al. | 4,919,724 | Apr. 24, 1990. |
| Walkden | 4,927,496 | May 22, 1990. |
| Nolan et al. | 5,484,952 | Jan. 16, 1996. |
| Zhang | 5,525,738 | Jun. 11, 1996. |

The disclosures of which are incorporated herein by reference.

These sizing agents when added to the wet end of the paper machine, at the size press, or to the finished product in an off-machine application impart water resistivity to the paper, by decreasing the hydrophilicity of the sheet. The use of these sizing agents in writing paper, liner board, grocery bag and milk carton is well known, as all of these paper products require sizing.

These types of sizing agents are known to produce very hard sized (high resistivity to wetting) material such a milk carton. The use of these sizing agents in tissue and towel, although not unknown, has been very limited, because water resistivity is not desirable in these products. To the contrary, it has generally long been a goal in the tissue and towel industry to increase rather than decrease the rate at which the product is wetted and the total amount of water that the product can absorb. An example, however, of the use of ketene dimer sizing agents in tissue and towel products to increase water resistivity is found in European Patent Application No. 0 144 658 in the name of Dan Endres, assigned to Kimberly-Clark Corp.

It has been discovered that the use of deactivated ketene dimer sizing agents in tissue and towel increases the softness to these products while not materially effecting their water absorbtivity or hydrophilicity.

SUMMARY OF THE INVENTION

In one embodiment of this invention, a soft absorbent tissue product comprising long and short paper making fibers and a having hydrolyzed ketene dimer agent is provided. A soft absorbent paper product comprising paper making fibers and at least about 1 pound per ton of a hydrolyzed ketene dimer agent, the tissue having an absorbency rate test of less than about 50 seconds is further provided.

In an additional embodiment of the invention, a soft absorbent tissue sheet comprising a first layer and a second layer with the first layer comprising predominately long paper making fibers and the second layer comprising predominantly short paper making fibers is provided. At least one of these layers further comprises a ketene dimer and this layer is readily wetable by water. This soft tissue may be creped or through dried. It may also have an absorbency rate test less than about 10 seconds.

In yet a further embodiment of the invention, a soft paper product having paper making fibers and at least about 1 pound per ton of fiber of a ketene dimer sizing agent that has been neutralized so that the product has an absorbency test of less than about 40 seconds is provided.

In still another embodiment of the invention, a paper sheet having improved softness comprising a first sheet surface and a second sheet surface and having a layer comprising paper making fibers is provided. The layer has a surface that corresponds to a surface of the paper sheet. The surface of the layer has a deactivated ketene dimer sizing agent therein so that the wetability of the sheet is equivalent to a sheet of similar composition but not having the deactivated ketene dimer sizing agent therein. This paper sheet may be a bath tissue having a second layer comprising paper making fibers, or be a towel product. This sheet may also be a facial tissue with two or more layers comprising paper making fibers. The sheet may also be a three layer sheet.

An additional embodiment of the present invention is a paper sheet having improved softness comprising cellulose paper making fibers and a hydrolyzed ketene dimer agent in which the sizing of the sheet is no greater than about three times the sizing of a sheet of similar composition but not having the hydrolyzed ketene dimer agent.

In an alternative embodiment of the invention, a method is provided for making a soft absorbent paper sheet product having improved softness. This method comprises forming in a pulper an aqueous slurry comprising paper making fibers, hydrolyzing a ketene dimer sizing agent, combining the product of the hydrolyzation of the ketene dimer sizing agent with the paper making fibers, and removing the water from the aqueous slurry to form a paper sheet. In this method, the product of the hydrolyzation of the ketene dimer may be combined with the paper making fibers either prior to, during or after the removal of water from the slurry.

In yet another embodiment of the invention a soft highly absorbent blended base sheet having a deactivated ketene dimer sizing agent is provided. This blended base sheet may have long and short paper making fibers.

DRAWINGS

FIG. 1 is a schematic process flow diagram generally showing the manufacture of paper products.

DETAILED DESCRIPTION OF PRESENTLY PREFERRED EMBODIMENTS OF THE INVENTION

Ketene dimers used in the paper industry to impart sizing, or water resistivity to paper, have a general chemical structure of

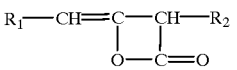

in which $R_1$ and $R_2$ can be a wide range of carbon backboned structures. Known structures and methods for making these products are disclosed in the aforementioned patents, which were incorporated herein by reference.

When such a sizing agent is used to impart water resistivity to paper, it is theorized that the four-member ring consisting of one oxygen and three carbon atoms, also known as a lactone ring, is primarily responsible for forming a covalent bond to the cellulose fiber. It is theorized that the lactone ring undergoes a reaction with the hydroxyl group on the cellulose. Once this reaction is complete the R groups are then reoriented, through the application of heat, air flow or pressure, away from the cellulose fiber. Thus, they in effect create a hydrophobic mono-molecular layer on the outer surface of the cellulose fiber. It is theorized that this outer hydrophobic surface layer provides the water resistivity to the paper product that is observed when these sizing agents are used.

When a ketene dimer sizing agent is hydrolyzed prior to coming in contact with cellulose fiber, its ability to size the sheet, i.e., impart water resistivity, is greatly diminished, if not eliminated. As such, the addition or formation in a paper machine of this hydrolyzed agent has long been avoided. It has surprisingly been found, however, that the addition of such hydrolyzed ketene dimer sizing agents to tissue and towel products increases softness, while allowing the product to remain hydrophilic. Thus, the water absorbtivity (both rate and total volume) is not materially effected.

Referring to FIG. 1, which is a schematic process flow diagram of a paper making process, cellulose fibers are prepared in a pulper (not shown) to form an aqueous slurry of fibers and water, which is referred to as stock or a stock solution. The stock is pumped into a chest 1, which may be referred to as a dump chest. From the dump chest the stock is pumped to another holding chest 2, which may be referred to as a machine chest. From the machine chest the stock is pumped by the fan pump 3 to the head box 4 of the paper making machine 5. At or before the fan pump, the stock is diluted with water. Usually, and preferably, the dilution is done with return water, referred to as white water, from the paper making machine. The flow of the white water is shown by lines 6 and 7. Prior to dilution the stock is referred to as thick stock, and after dilution the stock is referred to as thin stock.

The thin stock is then dewatered by the forming section 8 of the paper machine to form an embryonic web of wet cellulose fibers. The wet web is than transferred to a dryer 9, which removes water from the wet web forming a paper sheet. The paper sheet then leaves the dryer and is wound on reel 10.

It is to be understood that FIG. 1 is a general description of the paper making process and is meant to illustrate that process and is in no way meant to limit or narrow the scope of the present invention. Many variations in this process and equipment are know to those skilled in the art of paper making. For example, various types of dryers can be used including through air dryers, Yankee dryers with and without creping, tunnel dryers, and can dryers or any combination of these. Although the schematic generally shows a twin wire type forming section, other forming sections known to the art may be used. Additional components may also be added or removed from the process. For example, screens, filters and refiners, which are not illustrated, may be typically placed between the pulper and the head box. The transfer section 11 of the paper machine may not be present or may be expanded to include additional water removal devices. Additional steps may also be added on-machine after the dryer and before the reel, such as calendering and the use of a size press, although additional drying is usually required after a size press application is used. Calendering and coating operations may also be conducted off-machine.

Paper sheets can be made of long paper making fibers (softwood), short paper making fibers (hardwood), secondary fibers, other natural fibers, synthetic fibers, or any combination of these or other fibers known to those skilled in the art of paper making to be useful in making paper. Long paper making fibers are generally understood to have a length of about 2 mm or greater. Especially suitable hardwood fibers include eucalyptus and maple fibers. As used herein the term paper making fibers refers to any and all of the above.

As used herein, and unless specified otherwise, the term sheet refers generally to any type of paper sheet, e.g., tissue, towel facial, bath or a heavier basis weight product, creped or uncreped, blended, multilayer or single layered, and multiplied or singleplied.

The deactivation or neutralization of the ketene dimer sizing agent may be accomplished by hydrolyzing the agent. The formation of the hydrolyzed ketene dimer agent is accomplished by combining a ketene dimer sizing agent with water and then heating. This can most readily be accomplished by heating raw ketene dimer sizing agent in the presence of water. It is believed that this reaction is best carried out before the agent is added to the paper making system, but may be carried out in the paper making system if that system is such that the reaction can be essentially completed prior to the agent coming in contact with sufficient fibers so that the agent does not size the sheet.

The hydrolyzed ketene dimer agent can be added in the wet end of the paper machine to either the thick or thin stock. For wet end applications the hydrolyzed agent would preferably be formed into an emulsion and have a promotion agent added to it as well. Such promotion agents would include organic or inorganic retention aids such as polyaminoamides, polyamines, polyethyleneinime resin, poly diallydimethylammonium chloride polymers or copolymers, cationic starch, amphotheric starch, gums, and any other natural and synthetic polyelectrolytes and their derivatives. In addition to wet end addition, the hydrolyzed ketene dimer agent can be added to the embryonic web, partially dried sheet or dried sheet. It can be sprayed on or applied by roll application either as an on- or off-machine application. The optimum application point and method will depend on the particular paper type and machine, however, they should be selected to optimize the distribution of the hydrolyzed agent in or on the sheet, minimize the effect on the runabliity of the machine, such as to reduce the amount of foam, and maximize the softness increase for quantity of agent used.

The types of ketene dimer that are available to form the hydrolyzed ketene dimer agent can vary greatly. The hydrolyzed ketene dimer can be derived from either plant or animal fatty acids, which can have branched or unbranched, saturated or unsaturated R groups. Moreover, at least one R group may be substituted with an H. The presently preferred chain lengths for these R groups ranges $C_6$ to $C_{24}$ and may optionally range from around $C_8$ to around $C_{22}$ and further may optionally range from $C_8$ to $C_{18}$.

The amount of hydrolyzed ketene dimer agent that is added to the paper will depend on the ketene dimer being used, type and composition of the paper being made, and the manner and point in the paper making process in which the hydrolyzed agent is added. Presently between about 0.5 to about 5 pounds per ton of paper (dry basis weight) of hydrolyzed agent may be used. Although depending on the application, the benefits of this invention may be seen with lower and higher amounts. From about 0.5 to about 4 pounds per ton may optimally be used for wet end addition. The practical upper limits for the amount of hydrolyzed agent used will principally be controlled by machine runability, water absorbtivity of the sheet, and cost.

The addition of the hydrolyzed ketene dimer to the sheet does not materially effect the wetability of the sheet, i.e., it does not impart sizing to the sheet. Thus, the rate of water absorption and the total amount of water that a sheet softened with a hydrolyzed ketene dimer agent can absorb is not materially different from an equivalent sheet that does not have the hydrolyzed agent. These sheets can have as much as one to two fold increase in sizing compared to a sheet without the hydrolyzed agent, and still exhibit sufficient hydrophilicity.

Wetability of the sheet, or the amount of sizing, can be measured by a number of ways. Of course, all samples should be aged and tested in accordance with TAPPI standards.

Absorbency Rate Test—The absorbency rate is the time it takes for a product to be thoroughly saturated in distilled water. Samples are prepared as 2½ inch squares composed of 20 finished product sheets using a die press (e.g. TMI DGD from Testing Machines Incorporated Inc., Amityville, N.Y. 11701). The ply of a finished product dictates the number of individual sheets:

1-ply: 20 individual sheets 2-ply: 40 individual sheets 3-ply: 60 individual sheets When testing soft rolls (single ply of tissue coming off the tissue machine before plying at the rewinder), 40 individual softroll sheets are used per sample.

The samples are stapled in all four corners using Swingline S.F. 4 speedpoint staples (the staples are ½-inch wide with ¼-inch long legs). Samples are tested in a constant temperature water bath at a depth of at least 4 inches (maintained through out testing) maintaining distilled water at 30+/−1° Celsius. The sample is held close to the water surface (staple points in the down position) and then dropped flat on the water surface. A stopwatch (readable to 0.1 s) is started when the sample hits the water. When the sample is completely saturated; the stopwatch is stopped and the absorbent rate is recorded. A minimum of five samples are tested.

All tests were conducted in a standard laboratory atmosphere of 23+/1° Celsius and 50+/−2% RH. All samples were stored in this laboratory for at least 4 hours before testing. All samples are aged and tested at TAPPI conditions.

Hercules Size Test (HST)—A small volume of ink is placed on the paper sample to be tested. The sample amount is typically 1 to 5 layers of paper. A photo electric eye then measures the time that is required for the reflectance of the sample to drop to a specific level from its original point. This test is typically used for bleached board, cup stock, fine paper and linerboard grades. This test may be used for measurement of sizing in facial tissue grades.

Flotation Tests—A sample of paper is floated on a aqueous solution. The test is timed and reaches completion when the sample has become completely saturated with the test solution. The type of solution use is dependent on the end use of the paper. Typical solutions used are ink, water, fluorescent dye, and ammonium solutions. The use of flotation tests are usually limited to fine paper grades. Linerboard, gypsum board, and cup stock are typically not tested with this method due to the excessive time required to saturate the sample. A water bath saturation test may be used for measurement of sizing in facial tissue grades.

Boiling Boat—This test measures the time requirement for 'boat' shaped paper sample to completely saturate in boiling water. This test is typically used for highly sized grades such as gypsum and linerboard.

Valley Size Test—A sample of paper is connected at each end by an electrode. The sample is immersed into a water solution and the conductivity of the paper sample, after a predetermined period of time, is measured. The use of this test is typically limited to cylinerboard paper grades.

Currier—Sizing is measured by the time necessary for a paper sample, soaking in a aqueous fluid, to complete an electrical circuit. This test has been very popular for use in linerboard grades.

Immersion Test—A paper sample is weighted and then soaked in a water bath for a predetermined period of time. Sizing is measured by the weight of water that has been absorbed during the test. This test is often used for fine paper grades.

Edgewick—A sample of paper is immersed, on its edge, into a liquid sample of lactic acid, peroxide, coffee, etc. This test measures the amount of liquid that is picked up by the paper over a defined period of time. This test is exclusively used for food packaging grades such as milk cartons and other liquid for packaging applications.

Klemm—The end of a paper sample is immersed into a bath of liquid. Sizing is measured by the amount of time it takes for the liquid to raise up the sample to a predetermined point. This test is very flexible and can be used for many sized grades.

Typically, tissue made without the use of sizing agents shows an absorbency rate test of from about 1 second to about 10 seconds. Towel made without sizing agents will typically show an absorbency rate of about 1 to about 50 seconds. When tissue and towel are sized with a ketene dimer sizing agent it can be anticipated that sizing levels, or water resistivity, will substantially increase with absorbency rate tests of as much as 25 seconds or larger occurring in, for example, tissue. Tissue having improved softness from the use of hydrolyzed ketene dimer agents remain hydrophilic, having a very low resistance to wetting, i.e., they are not sized and thus wet easily. The water absorbency rate test for such softened sheets are from around 1 to around 4 seconds, but may be up to about 10 seconds or more depending on the type of paper, basis weight and other physical characteristics of the sheet. For tissue and towel products water absorbency test results of less than 40 seconds are believed to show that the sheet is still substantially hydrophilic, and are viewed as low or negligible levels of sizing.

Sizing agents may typically exhibit a threshold effect in the development of water resistivity. Thus, for example, the initial ¼to 2 lbs/ton of sizing agent may develop little or no increased water resistivity. But at any higher amounts the increase in water resistivity may be substantial. This threshold level will vary from paper type to paper type and from sizing agent to sizing agent. Using a deactivated sizing agent, thus permits addition of this agent above the threshold level of sizing to obtain the softened benefits without experiencing a dramatic loss of hydropholicity.

Described below is an example of a wet-end stock system which could be used in the manufacture of tissue having a deactivated sizing agent. A split stock system with several chests for the storage of an aqueous suspension of papermaking fibers can be used. From these chests, the fiber-water suspensions may enter separate stuffboxes used to maintain a constant pressure head. A split stock system has the advantage of being able to selectively apply chemicals to certain fibers and to layer these fibers during the forming process. Alternatively, a single stream stock system can be used with one chest, one stuffbox, and one fan pump.

A portion of the outlet stream of stuffbox can be drawn off as a separate stream and sent to a fan pump while the remaining portion can be recirculated back to the top of the stuff box. Alternatively, the entire outlet of the stuffbox can be sent to the fan pump.

Deactivated sizing agents produced by hydrolyzing alkyl ketene dimer (Hercon) in hot water can be added at any point in the process. This agent may be added alone, with a retention aid, or with any other chemicals that aid in the distribution and retention of the agent on the fibers. Other function chemicals, such as dry strength resins and wet strength resins can also be added. Additionally, the stock can be passed through refiners. Papermaking fibers treated with deactivated sizing agents can be supplied to all or some of the headbox layers. In order to reach the targeted wet out time for a product, absorbency rate or wet out time can be controlled by varying the dosage level of the deactivated sizing agent or varying the % or degree of deactivation of the sizing agent. Thus, by way of illustration the sizing agent may be 80% deactivated, rather than 100% deactivated. Some delayed wet out or sizing may be beneficial for certain products. Thus, controlled wet out time or absorbency of the final product or any layer or ply within the final product can be achieved. This may be particularly useful in creating moisture barriers in some layers of the paper product will be maintaining absorbency in other layers.

Deactivated sizing agents can be applied to the dry web by spraying an aqueous solution through a spray boom, or dryer section. Similarly, deactivated sizing agents can be sprayed in offline rewinder operations by using a similar spray boom or by other offline application methods used in papermaking.

EXAMPLE 1

Eucalyptus fibers are pulped for 30 minutes and are placed in a dump chest which feeds into a machine chest. Likewise a mixture of 72% Northern Softwood Kraft and 28% Northern Hardwood Kraft is pulped for 30 minutes and is placed in a dump chest which feeds into another machine chest. The eucalyptus fiber enters one section of a multilayer stuffbox and exits through a stream. No chemical addition is made to this stream. The Northern Softwood/Northern Hardwood Kraft fiber mixture in the machine chest is fed to another section of the multilayer stuffbox. Deactivated Hercon 79 (Hercon 79 is available from Hercules Incorporated) is fed into the stuffbox outlet at an addition rate of 1.25 lb/ton of solids per total sheet weight. A commercially available wet-strength agent is added in the amount of 0.82 lbs/ton of active solids per total sheet weight. The final sheet has the following fiber composition: 50% Eucalyptus, 36% Northern Softwood Kraft, and 14% Northern Hardwood Kraft. The sheet is soft and highly absorbent.

What is claimed is:

1. A soft highly absorbent tissue product comprising long and short paper making fibers and a hydrolyzed ketene dimer agent.

2. A soft absorbent paper product comprising paper making fibers and at least about 1 pound per ton of a hydrolyzed ketene dimer agent, the tissue having an absorbency rate test of less than about 50 seconds.

3. The paper product of claim 2 in which the product further comprises a three-layer base sheet.

4. A paper sheet having improved softness comprising cellulose paper making fibers and a hydrolyzed ketene dimer agent; the sizing of the sheet being no greater than about three times the sizing of a sheet of similar composition but not having the hydrolyzed ketene dimer agent.

5. A method of making a soft absorbent paper sheet product having improved softness comprising:

(a) forming an aqueous slurry comprising paper making fibers in a pulper;

(b) hydrolyzing a ketene dimer sizing agent;

(c) combining the product of the hydrolyzation of the ketene dimer sizing agent with the paper making fibers;

(d) removing the water from the aqueous slurry.

6. The method of claim 5, in which the product of the hydrolyzation of the ketene dimer is combined with the paper making fibers prior to the removal of water from the slurry.

7. The method of claim 5, in which the product of the hydrolyzation of the ketene dimer is combined with the paper making fibers after the removal of water from the aqueous slurry.

8. A soft highly absorbent paper product comprising a blended base sheet and a deactivated ketene dimer sizing agent; said blended basesheet comprising long and short papermaking fibers.

* * * * *